US007457567B2

(12) United States Patent
Kishigami

(10) Patent No.: US 7,457,567 B2
(45) Date of Patent: Nov. 25, 2008

(54) IMAGE FORMING APPARATUS THAT PREVENTS DISPLACEMENT OF ROTARY MEMBER

(75) Inventor: Minoru Kishigami, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 40 days.

(21) Appl. No.: 11/409,719

(22) Filed: Apr. 24, 2006

(65) Prior Publication Data

US 2006/0263115 A1 Nov. 23, 2006

(30) Foreign Application Priority Data

Apr. 28, 2005 (JP) ..... 2005-130757

(51) Int. Cl.
*G03G 15/01* (2006.01)

(52) U.S. Cl. ..... 399/227

(58) Field of Classification Search ..... 399/226, 399/227

See application file for complete search history.

(56) References Cited

U.S. PATENT DOCUMENTS 4,922,301 A 5/1990 Katoh et al.
4,939,548 A * 7/1990 Yamada et al. ..... 399/226
5,587,783 A * 12/1996 Nakamura et al. ..... 399/277 X
7,162,186 B2 * 1/2007 Moritani ..... 399/227
2003/0095804 A1 * 5/2003 Tanaka et al. ..... 399/13
2005/0008415 A1 * 1/2005 Tanaka et al. ..... 399/358
2005/0078983 A1 * 4/2005 Maruyama et al. ..... 399/227

FOREIGN PATENT DOCUMENTS

EP 1 508 840 2/2005
JP 2005-024859 1/2005

* cited by examiner

*Primary Examiner*—Sandra L Brase
(74) *Attorney, Agent, or Firm*—Hogan & Hartson LLP

(57) ABSTRACT

An image carrier is adapted such that an electrostatic latent image is formed thereon. A rotary member has a plurality of loading sections each of which is adapted to accommodate a developing device which is operable to develop the electrostatic latent image. A motor is operable to rotate the rotary member so that each of the loading sections is sequentially opposed to the image carrier, and operable to exert a detent torque when no power is supplied thereto. A home position is defined, in a case where only one of the loading sections accommodates the developing device, such that the one of the loading sections is placed in a position lower than any other loading sections. The motor rotates the rotary member to the home position at least when the development of the electrostatic latent image is not performed. The rotary member is retained in the home position with the detent torque exerted by the motor.

12 Claims, 13 Drawing Sheets

IMAGE FORMING APPARATUS THAT PREVENTS DISPLACEMENT OF ROTARY MEMBER

BACKGROUND OF THE INVENTION

The present invention relates to an image forming apparatus and an image forming system incorporating the same.

An image forming apparatus, such as a laser beam printer, has already been well known. Such an image forming apparatus comprises, for example, an image carrier for carrying a latent image thereon; developing devices, each of which develops the latent image carried on the image carrier with use of a developing agent; a rotary member having a plurality of loading sections arranged in a circumferential direction thereof and allowing removable loading of the developing devices; and a motor for rotating the rotary member. The image forming apparatus can perform image forming operation with a single developing device loaded in one of the loading sections.

When an image signal is transmitted from an external apparatus, such as a host computer, to the image forming apparatus, the rotary member situated at a home position, where the rotary member awaits execution of image forming operation, is rotated by driving force of the motor, so that the developing device is placed at the development position opposing the image carrier. The latent image carried on the image carrier is developed with the developing agent stored in the developing device, to thus form a visible image, and the visible image is transferred onto a medium, thereby eventually forming an image. Such an image forming apparatus is disclosed in Japanese Patent Publication No. 2005-24859A, for example.

When the developing device remains loaded only in one of the plurality of loading sections, the distribution of load (weight) of the rotary member becomes uneven, to thus bring imbalance to the rotary member. Therefore, when the rotary member is situated at the home position, there may arise a case where the rotary member becomes displaced (rotated) under the own weight of the developing device, depending on the position of the one loading section to which the developing device is loaded. In a case where an impact is inflicted on the rotary member when the rotary member is situated at the home position, the rotary member is displaced (rotated) by the impact.

In order to prevent displacement of the rotary member, the related-art printer is equipped with a stopper which comes in contact with the rotary member situated in the home position. However, in order to cause the stopper to duly exhibit its function, the strength of the stopper must be sufficiently ensured.

SUMMARY OF THE INVENTION

It is therefore an object of the invention to provide an image forming apparatus which can prevent undesirable displacement of a rotary member.

It is also an object of the invention to provide an image forming system incorporating such an image forming apparatus.

In order to achieve at least one of the above objects, according to the invention, there is provided an image forming apparatus, comprising:

an image carrier, adapted such that an electrostatic latent image is formed thereon;

a rotary member, having a plurality of loading sections each of which is adapted to accommodate a developing device which is operable to develop the electrostatic latent image; and a motor, operable to rotate the rotary member so that each of the loading sections is sequentially opposed to the image carrier, and operable to exert a detent torque when no power is supplied thereto; wherein:

a home position is defined, in a case where only one of the loading sections accommodates the developing device, such that the one of the loading sections is placed in a position lower than any other loading sections;

the motor rotates the rotary member to the home position at least when the development of the electrostatic latent image is not performed; and the rotary member is retained in the home position with the detent torque exerted by the motor.

Alternatively, there is provided an image forming apparatus, comprising:

an image carrier, adapted such that an electrostatic latent image is formed thereon;

a rotary member, having a plurality of loading sections each of which is adapted to accommodate a developing device which is operable to develop the electrostatic latent image; and a motor, operable to rotate the rotary member so that each of the loading sections is sequentially opposed to the image carrier, and operable to exert a detent torque when no power is supplied thereto; wherein:

a home position is defined, in a case where only one of the loading sections accommodates the developing device, such that the one of the loading sections is placed in a position higher than any other loading sections;

the motor rotates the rotary member to the home position at least when the development of the electrostatic latent image is not performed; and the rotary member is retained in the home position with the detent torque exerted by the motor.

In a case where the one of the loading sections is located at the highest or lowest position among the plurality of loading sections when the rotary member is situated at the home position, the rotary member becomes stable. Moreover, in a case where the motor retains the rotary member at the home position with the detent torque, the detent torque acts as retaining force for retaining the rotary member. When these two matters are combined together, the rotary member situated at the home position is retained more stably. Accordingly, an image forming apparatus capable of preventing displacement (rotation) of the rotary member situated at the home position can be provided.

The motor may be a stepping motor. Since the detent torque of the stepping motor is relatively high, the rotary member situated at the home position is retained more stably.

The rotary member may be retained in the home position without any locking member. In this case, the number of components can be diminished.

The motor may rotate the rotary member to the home position when the image forming apparatus is deactivated.

The motor may rotate the rotary member to a replacement position in which the one of the loading sections equipped with the developing device is placed in a position higher than any other loading sections, when replacement of the developing device is performed. The rotary member may be retained in the replacement position with the detent torque exerted by the motor.

Alternatively, the motor may rotate the rotary member to a replacement position in which the one of the loading sections equipped with the developing device is placed in a position lower than any other loading sections, when replacement of the developing device is performed. The rotary member may be retained in the replacement position with the detent torque exerted by the motor.

In any of the cases, since the rotary member situated at the replacement position is retained stably, the operator can smoothly perform the replacement of the developing device.

In order to achieve at least one of the objects, according to the invention, there is also provided an image forming system, comprising:

the above image forming apparatus; and a computer, communicatively connected to the image forming apparatus and operable to cause the image forming apparatus to execute an image forming operation.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Embodiments of the invention will be described below in detail with reference to the accompanying drawings.

Figure 1:
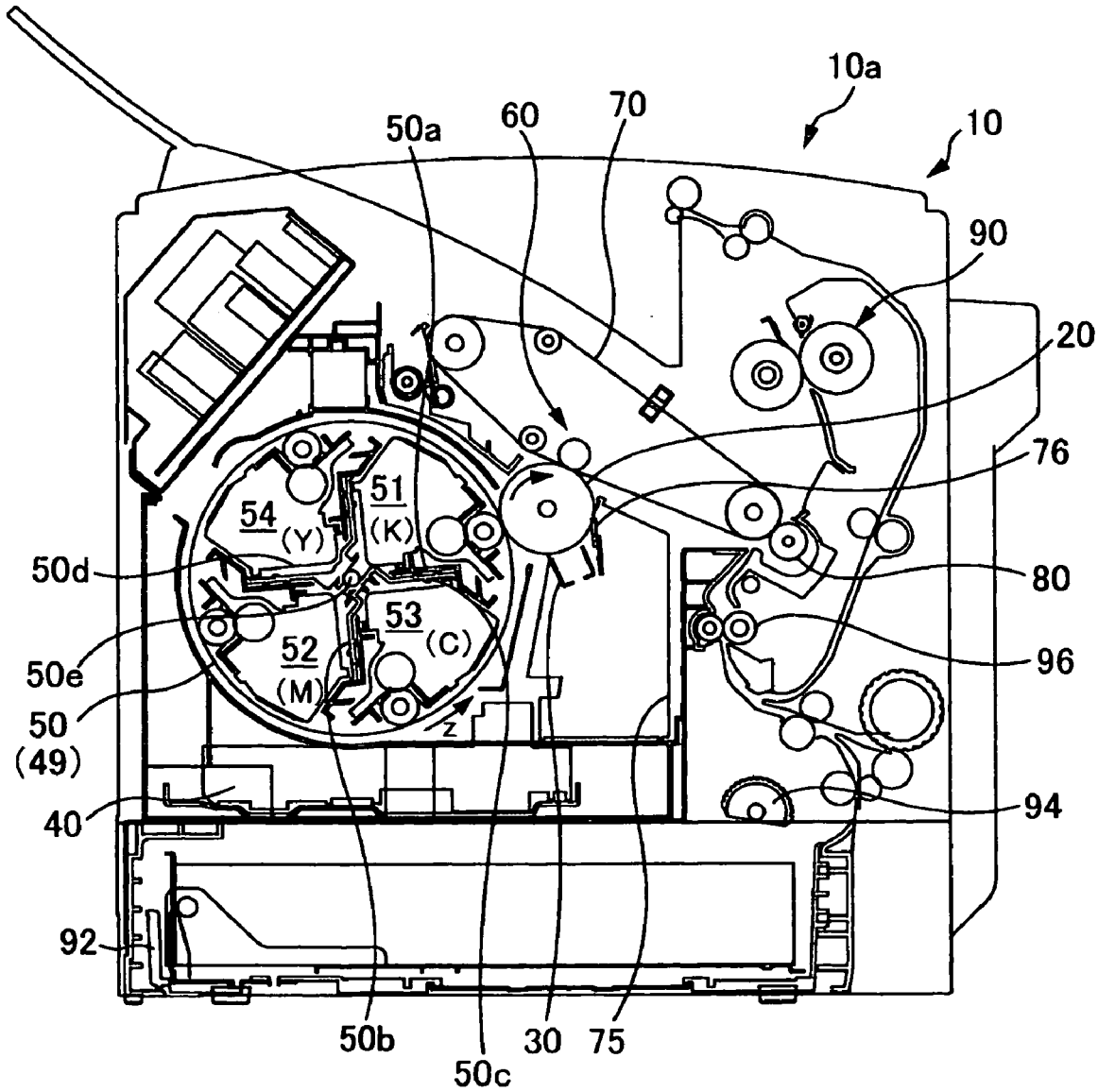
FIG. 1 is a schematic section view of a printer according to one embodiment of the invention, showing a state that the printer is used as a full-color printer.
Figure 2:
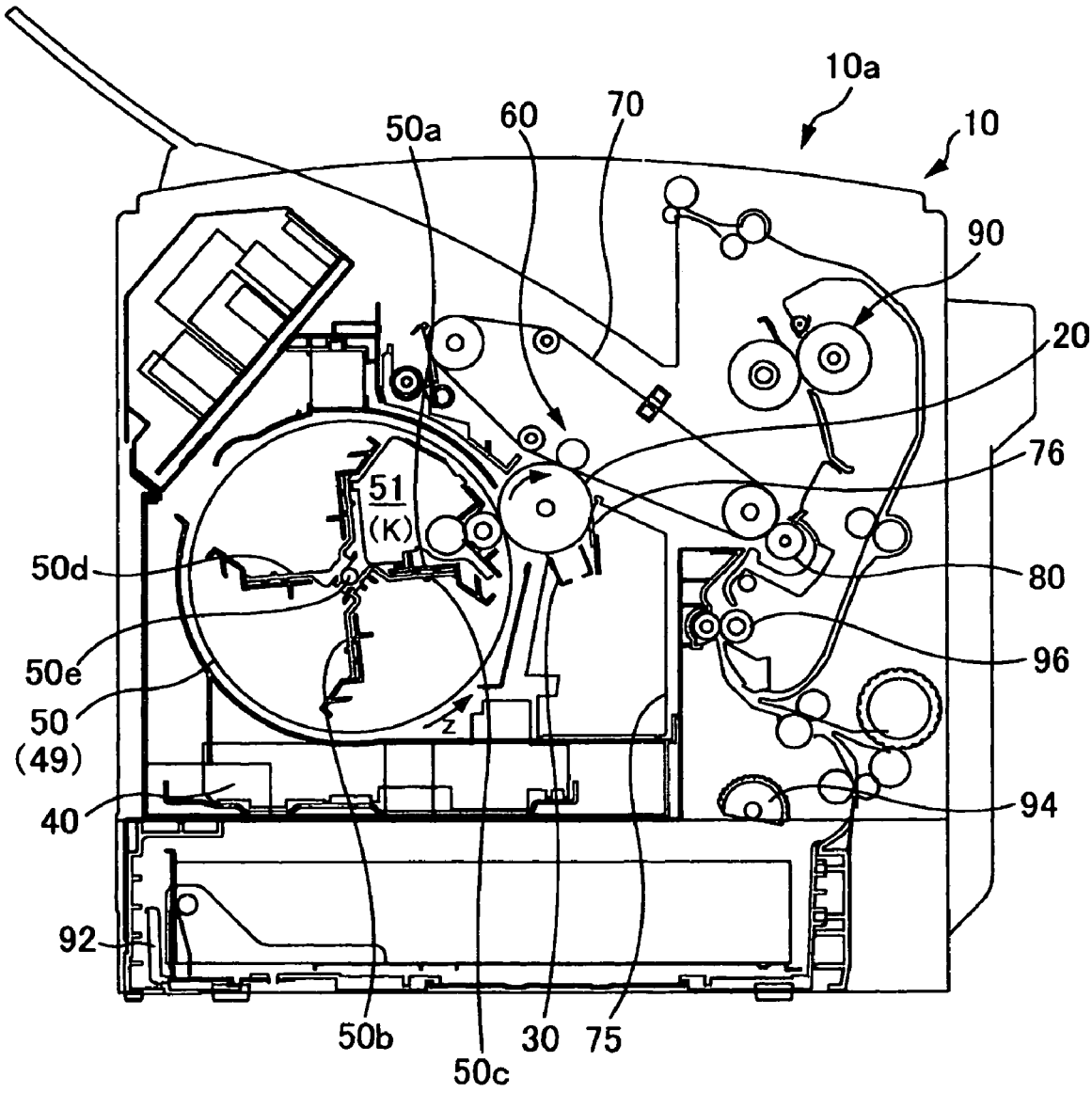
FIG. 2 is a schematic section view of the printer, showing a state that the printer is used as a monochrome printer.

As illustrated in FIGS. 1 and 2, a printer 10 according to one embodiment of the invention has, along a rotational direction of a photosensitive body 20 serving as an image carrier for carrying a latent image thereon, a charging unit 30, an exposing unit 40, a developing device holder 49, a primary transferring unit 60, an intermediate transferring member 70, and a cleaning unit 75. The printer 10 further has a secondary transferring unit 80; a fusing unit 90; a display unit provided with a liquid crystal panel or the like; and a control unit 100 which controls these units and manages operation of the printer.

The photosensitive body 20 has a cylindrical, conductive substrate and a photosensitive layer formed on the circumferential surface thereof. The photosensitive body 20 can rotate about a center axis; in the present embodiment, can rotate clockwise as indicated by an arrow in each of FIGS. 1 and 2.

The charging unit 30 is a unit for charging the photosensitive body 20. The exposing unit 40 is a unit for irradiating the charged photosensitive body 20 with a laser beam to thereby form a latent image thereon. The exposing unit 40 comprises a semiconductor laser, a polygon mirror, an F-θ lens, and the like, and emits a laser beam which has been modulated in accordance with image information input from an unillustrated external device such as a personal computer, a word processor.

The developing device holder 49 has a rotary 50. The rotary 50 is equipped with a plurality of loading sections 50*a*, 50*b*, 50*c*, and 50*d*, each of which allows removable loading of a developing device for developing a latent image formed on the photosensitive body 20 through use of toner T stored therein.

When the plurality of loading sections 50*a*, 50*b*, 50*c*, and 50*d* are respectively equipped with the developing devices, the printer 10 of the present embodiment can be used as a full-color printer which develops a latent image formed on the photosensitive body 20 with use of the toner T stored in the respective developing devices, to thus form a color image. When the developing device is loaded to only one of the plurality of loading sections 50*a*, 50*b*, 50*c*, and 50*d*, the printer 10 can be used as a monochrome printer which develops the latent image carried on the photosensitive body 20 with the toner T stored in that developing device, to thereby form a monochrome image.

In order to enable formation of a full-color image at any time, a conventional printer is arranged to not form even a monochrome image unless a plurality of developing devices storing toner of different colors are loaded to the developing device holder. In contrast, the printer 10 of the present embodiment operates also as a monochrome printer which enables formation of a monochrome image on a medium through use of an loaded black developing device 51 even if only the black developing device 51 is loaded to the developing device holder 49.

When the printer 10 is used as a full-color printer, four developing devices; namely, the black developing device 51, a magenta developing device 52, a cyan developing device 53, and a yellow developing device 54, are inserted respectively to the plurality of loading sections 50*a*, 50*b*, 50*c*, and 50*d* of the rotary 50, as illustrated in FIG. 1. The latent image formed on the photosensitive body 20 is then developed with the toner T stored in the respective developing devices.

The rotary 50 can move the four developing devices 51, 52, 53, and 54 by rotation. More specifically, the four developing devices 51, 52, 53, and 54 can rotate around a rotary shaft 50*e* while maintaining their relative positions. Every time formation of an image of one page is completed, the developing device selectively opposes the photosensitive member 20, and the latent image formed on the photosensitive member 20 is sequentially developed with the toner T stored in the developing devices 51, 52, 53, and 54.

Meanwhile, when the printer 10 is used as a monochrome printer, the developing device is loaded to only one of the plurality of loading sections of the rotary 50, as illustrated in FIG. 2. The latent image formed on the photosensitive body 20 is developed with the toner T housed in that developing device. Specifically, when the black developing device 51 is loaded to one loading section 50*a* of the four loading sections 50*a*, 50*b*, 50*c*, and 50*d* to thus form an image, the black developing device 51 moves to the position opposing the photosensitive body 20 as a result of rotation of the rotary 50.

The latent image formed on the photosensitive body 20 is developed with black toner T stored in the black developing device 51.

The developing devices and the loading sections, all of which pertain to the present embodiment, are configured so that each of the developing devices can be physically loaded solely to one corresponding loading section.

Specifically, of the four loading sections 50*a*, 50*b*, 50*c*, and 50*d*, only the loading section 50*a* enables loading of the black developing device 51; only the loading section 50*b* enables loading of a magenta developing device 52; only the loading section 50*c* enables loading of a cyan developing device 53; and only the loading section 50*d* enables loading of a yellow developing device 54.

The developing device holder 49 and the developing devices will be described in detail later.

The primary transferring unit 60 is a unit for transferring, onto the intermediate transferring unit 70, a toner image formed on the photosensitive body 20.

The intermediate transferring unit 70 is a multilayer endless belt formed by providing a tin-deposited layer on the surface of a PET film, and further forming a semi-conductive coating layer on the surface of the tin-deposited layer. The intermediate transferring member 70 is circulated at a velocity which is substantially the same as a circumferential velocity of the photosensitive body 20.

The secondary transferring unit 80 is a unit for transferring onto a medium, such as paper, a film, or cloth, a toner image formed on the intermediate transferring unit 70.

The fusing unit 90 is a unit for fusing the toner image transferred onto the medium, thereby rendering an image permanent.

The cleaning unit 75 is disposed between the primary transferring unit 60 and the charging unit 30, and has a rubber cleaning blade 76 remaining in contact with the surface of the photosensitive body 20. The cleaning unit 75 is a unit for, after a toner image has been transferred onto the intermediate transferring unit 70 by the primary transferring unit 60, scraping off and removing the toner T still remaining on the photosensitive body 20 by the cleaning blade 76.

Figure 3:
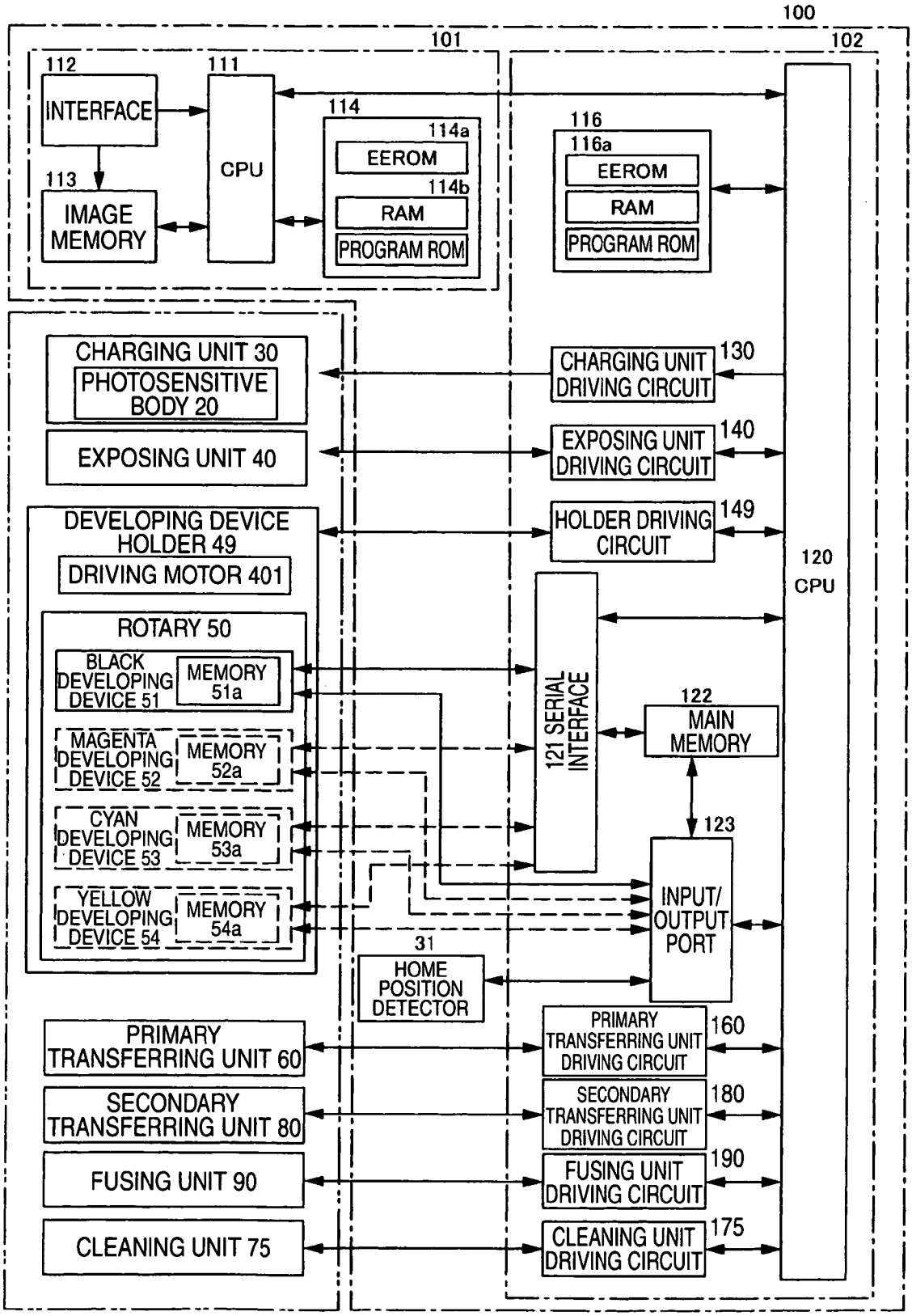
FIG. 3 is a block diagram of a control unit in the printer.

As shown in FIG. 3, the control unit 100 has a main controller 101 and a unit controller 102. An image signal and a control signal are input to the main controller 101, and the unit controller 102 controls the respective units, and the like, in accordance with the image signal and the control signal, to thus form an image.

The main controller 101 includes a CPU 111; an interface 112 used for establishing connection with an unillustrated computer; an image memory 113 for storing an image signal, and the like, input from the computer; and a main controller memory 114. The main controller memory 114 comprises an electrically-rewritable EEPROM 114*a*, a RAM 114*b*, a program ROM provided with programs for use in various control operations, and the like.

The CPU 111 of the main controller 101 manages control of operation for writing or reading the image data, which are input by way of an interface, into or from the image memory 113 as well as control of the entire image forming apparatus in synchronism with a CPU 120 of the unit controller 102 in accordance with a control signal input from the computer.

The EEPROM 114*a* stores mode data indicating whether the printer 10 is to be used as a full-color printer or a monochrome printer. The CPU 111 receives, at given timing from the unit controller 102, data pertaining to loading of a developing device (hereinafter called "developing device loading data") indicating which one of the four loading sections is equipped with the developing device. The CPU 111 rewrites the mode data in the EEPROM 114*a* in accordance with the loading data, as required. The mode data have already been written in the EEPROM 114*a* in the form of 1-bit data. When the value of the data is 0, the data indicate a full-color printer. When the value of the data is 1, the data indicate a monochrome printer. When the printer 10 is activated, the main controller 101 detects the power supply and loads the mode data from the EEPROM 114*a* to the RAM 114*b*. Even when the printer 10 is not activated, the mode data are stored in the EEPROM 114*a*.

The unit controller 102 comprises the CPU 120; a unit controller memory 116 including an electrically-rewritable EEPROM 116*a*, a RAM, a program ROM provided with programs for use in various control processes, or the like; and various driving circuits for controlling operations of the respective units of the main body of the printer (i.e., a charging unit driving circuit 130, a exposing unit driving circuit 140, a holder driving circuit 149, a primary transferring unit driving circuit 160, a cleaning unit driving circuit 175, a secondary transferring unit driving circuit 180, and a fusing unit driving circuit The CPU 120 of the unit controller 102 is electrically connected to the respective driving circuits, and controls the respective driving circuits in accordance with control signals output from the CPU 111 of the main controller 101. More specifically, the CPU 120 receives signals output from sensors provided in the respective units, thereby controlling the respective units in accordance with the signals input from the main controller 101 while detecting the statuses of the respective units.

The CPU 120 also controls the respective driving circuits in accordance with the mode data. Specifically, when the value of the mode data is 0, the CPU 120 controls the respective units of the printer 10 in such a way that the printer functions as a full-color printer. When the value of the apparatus data is 1, the CPU 120 controls the respective units of the printer 10 in such a way that the printer functions as a monochrome printer.

The EEPROM 116*a* stores the developing device loading data indicating which one of the four loading sections is equipped with the developing device. The CPU 120 determines whether or not a developing device is loaded to the loading section assigned to the removed/loaded developing device after removal/loading of the developing device. On the basis of the result of determination, the loading data in the EEPROM 116*a* are rewritten, as required. The loading data have already been written in the EEPROM 116*a* as 1-bit data; i.e., a total of four bits of data, for the loading sections. When the loading data assume a value of 0, the data show that no developing device is loaded. In contrast, when the loading data assume a value of 1, the data show that the developing device has been loaded.

The CPU 120 of the unit controller 102 is connected to a nonvolatile main memory 122 such as serial EEPROM, by way of a serial interface 121. This main memory 122 stores data required for controlling the apparatus. The CPU 120 is connected to memories 51*a*, 52*a*, 53*a*, and 54*a* (hereinafter called "developing device memories") provided in the respective developing devices 51, 52, 53, and 54 by way of the serial interface 121, as well as to the main memory 122. Data can be transferred between the main memory 122 and the developing device memories 51 *a*, 52*a*, 53*a*, and 54*a*. Further, a chip select signal CS can be input to the respective developing device memories 51*a*, 52*a*, 53*a*, and 54*a* by way of an input/output port 123. The CPU 120 is connected to a home position detector 31, as well, by way of the input/output port 123.

The rotary 50 can be equipped with the black developing device 51 containing black (K) toner, the magenta developing device 52 containing magenta (M) toner, the cyan developing device 53 containing cyan (C) toner, and the yellow developing device 54 containing yellow (Y) toner. Since the respective developing devices have the same configuration, the configuration of the black developing device 51 will now be described.

Figure 4:
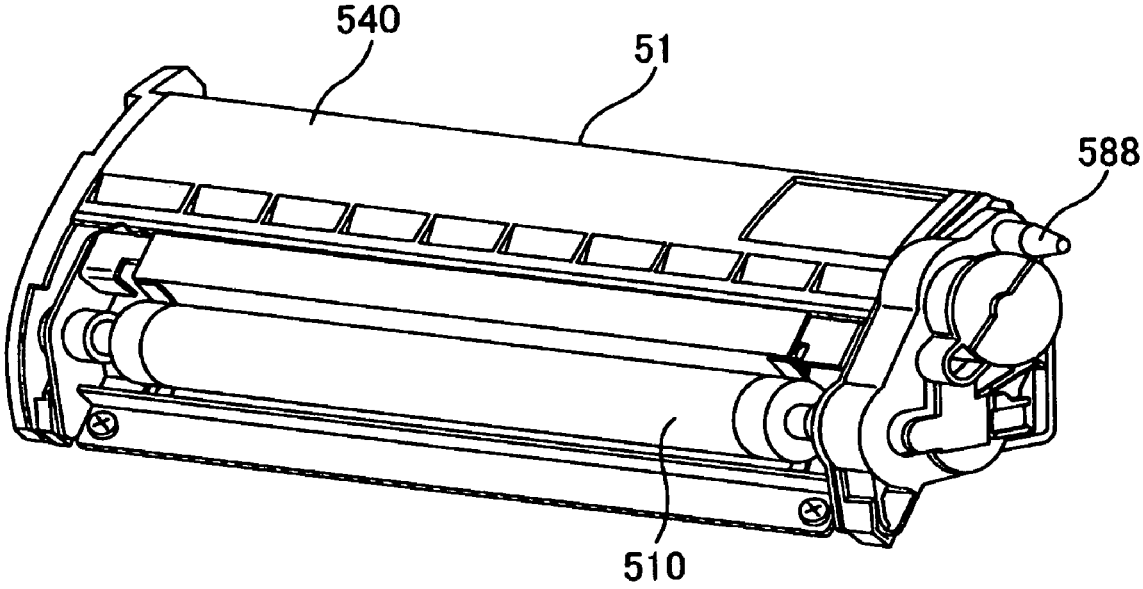
FIG. 4 is a perspective view of a black developing device in the printer.
Figure 5:
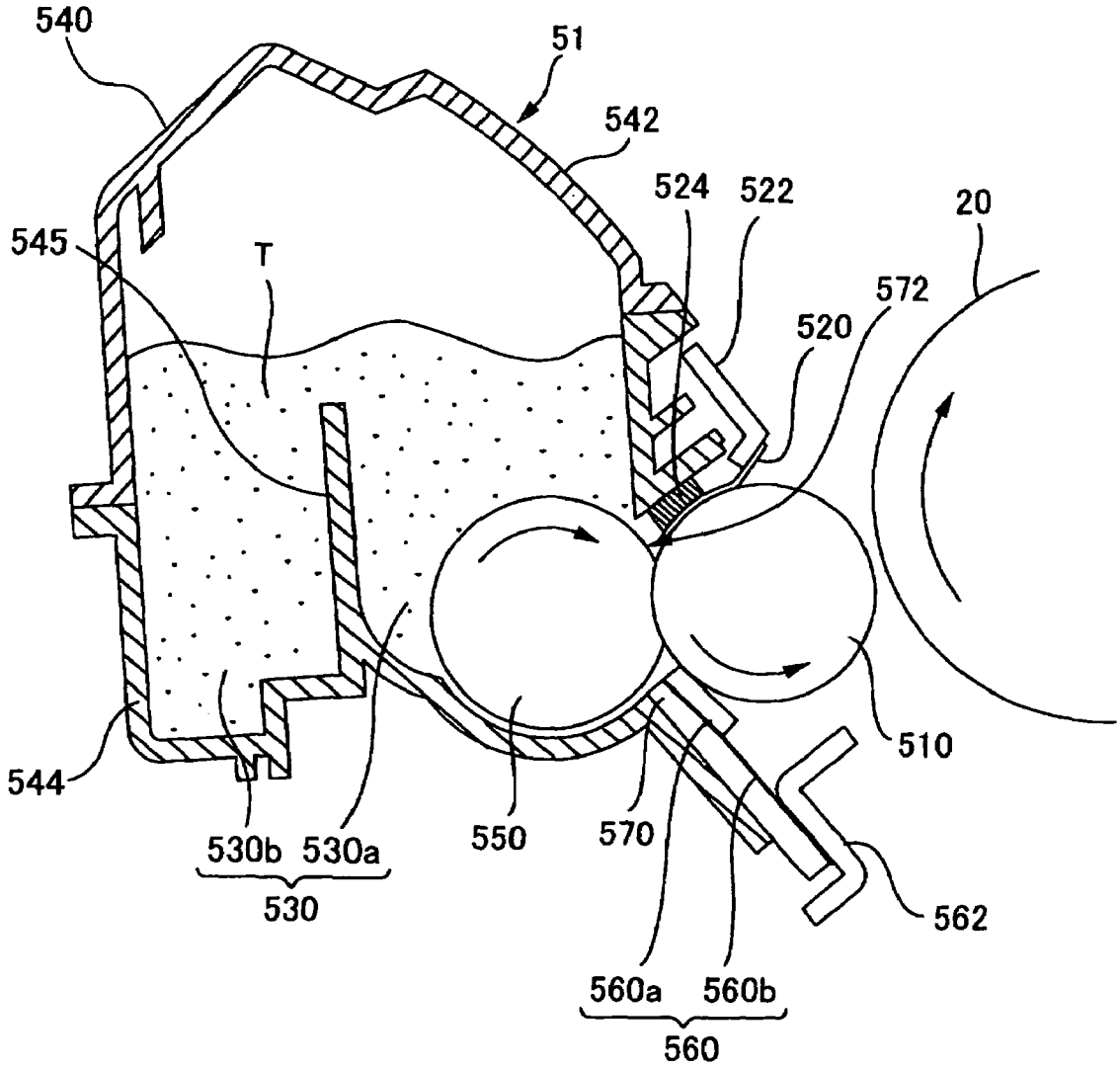
FIG. 5 is a vertical section view of the black developing device.

As shown in FIGS. 4 and 5, the black developing device 51 comprises the developing roller 510, a sealing member 520, a toner storage section 530, a housing 540, a toner supplying roller 550, a control blade 560, a positioning pin 588.

The developing roller 510 carries thereon and transports toner T to the developing position opposing the photosensitive body 20. This developing roller 510 is made from metal; that is, manufactured from an aluminum alloy such as a 5056 aluminum alloy or a 6063 aluminum alloy, a ferroalloy such as STKM, and the like. The metal roller is plated with nickel or chromium, as required.

As shown in FIG. 4, the developing roller 510 is supported at both longitudinal ends thereof and can rotate around the center axis thereof. As shown in FIG. 5, the developing roller 510 rotates in a direction (the counterclockwise direction in this figure) opposite the rotational direction (the clockwise direction in this figure) of the photosensitive body 20. The center axis of the developing roller 510 is located at a position that is lower than the center axis of the photosensitive body 20. A gap exists between the developing roller 510 and the photosensitive body 20, with the black developing device 51 opposing the photosensitive body 20. In short, the black developing device 51 develops the latent image formed on the photosensitive body 20 in a non-contact manner. When the latent image formed on the photosensitive body 20 is developed, an alternating electric field develops between the developing roller 510 and the photosensitive body 20.

The sealing member 520 prevents leakage of the toner T out of the black developing device 51, and recovers the toner T on the developing roller 510, which has passed by the developing position, into the developing device without scraping it off the developing roller. The sealing member 520 is a seal which is made of a polyethylene film, or the like. The sealing member 520 is supported by a supporting plate 522, and is mounted on the housing 540 by way of this supporting plate 522. A side of the sealing member 520 opposite to the side thereof opposing the development roller 510 is provided with an impelling member 524 made of mortoprain, or the like. The sealing member 520 is pressed against the developing roller 510 by elastic force of the impelling member 524. The location where the sealing member 520 comes into contact with the developing roller 510 is higher than the center axis of the developing roller 510.

The housing 540 is manufactured by welding together a plurality of integrally-molded housing members; that is, an upper housing member 542 and a lower housing member 544. The inside of the housing 540 is divided into two toner storage sections 530; namely, a first toner storage section 530*a* and a second toner storage section 530*b*, by a partition 545 which vertically protrudes from an inner wall for partitioning the toner T. An opening 572 is formed in a lower portion of the housing 540, and the developing roller 510 is arranged in the opening 572, with a portion of the developing roller 510 being exposed.

A stirring member for stirring the toner T may be provided in the toner storage section 530. However, in the present embodiment, the respective developing devices (the black developing device 51, the magenta developing device 52, the cyan developing device 53, and the yellow developing device 54) rotate in association with the rotation of the developing unit holding unit 49. Thus, the toner T in the respective developing devices is stirred, and hence the stirring member is not provided in the toner storage section 530.

The toner supplying roller 550 is disposed in the first toner storage section 530*a*, and supplies to the developing roller 510 the toner T stored in the first toner storage section 530*a*. The toner supplying roller 550 is made of polyurethane foam, or the like, and remains in contact with the developing roller 510 while being elastically deformed. The toner supplying roller 550 is provided in a lower portion of the toner storage section 530. The toner T stored in the toner storage section 530 is supplied to the developing roller 510 by the toner supplying roller 550 at the lower portion of the toner storage section 530.

As shown in FIG. 5, the toner supplying roller 550 is capable of rotating about the center axis thereof, and the center axis is located in a position that is lower than the center axis of the developing roller 510. The toner supplying roller 550 rotates in a direction (the clockwise direction in this figure) opposite the rotational direction of the development roller 510 (the counterclockwise direction in this figure). The toner supplying roller 550 has the function of stripping off the toner T, which still remains on the developing roller 510 after developing operation, from the developing roller 510 as well as the function of supplying to the developing roller 510 the toner T stored in the toner storage section 530.

The control blade 560 electrically charges the toner T carried by the developing roller 510, and regulates the thickness of the toner T carried by the developing roller 510. This control blade 560 has a rubber section 560*a* and a supporting section 560*b*. The rubber section 560*a* is made of a silicone rubber, a urethane rubber, or the like. The supporting section 560*b* is an elastic plate member which is made of phosphor bronze, stainless steel, or the like. The rubber section 560*a* is supported by the supporting section 560*b*. The supporting section 560*b* is fastened to the housing 540 via a supporting plate 562. In addition, an impelling member 570 made of mortoprain, or the like, is disposed on a side of the control blade 560 opposite the side thereof facing the developing roller 510.

The rubber section 560*a* is pressed against the developing roller 510 by elastic force stemming from flexure of the supporting section 560*b*. In addition, the impelling member 570 prevents the toner T from entering between the rubber support section 560*b* and the housing 540 to thereby stabilize the elastic force stemming from flexure of the supporting section 560*b*; and impels the rubber section 560*a* toward the developing roller 510 from the right behind of the rubber section 560*a*, thereby pressing the rubber section 560*a* against the developing roller 510. Therefore, the impelling member 570 enhances uniform contact of the rubber section 560*a* against the developing roller 510.

The side of the control blade 560 opposite the side thereof supported by the supporting plate 562; namely, the edge of the control blade 560, remains out of contact with the developing roller 510. A portion of the control blade 560, which is spaced a predetermined distance away from the edge thereof, remains, over a width, in contact with the developing roller 510. Specifically, the edge of the control blade 560 does not remain in contact with the development roller 510, but the body of the control blade 560 remains in contact with the developing roller 510. The control blade 560 is also arranged such that the edge thereof is oriented upstream with respect to the rotational direction of the developing roller 510. Thus, the control blade 560 remains in a so-called counter contact with the developing roller. The position where the control blade 560 contacts, the developing roller 510 is lower than the center axis of the developing roller 510, as well as being lower than the center axis of the toner supplying roller 550.

The positioning pin 588 is for positioning the black developing device 51 onto the rotary 50 (more specifically, the loading section 50*a*) and fit into a hole 59*b* (described later).

In the black developing device 51 configured as above, the toner supplying roller 550 supplies the toner T stored in the toner storage section 530 to the developing roller 510. In association with rotation of the developing roller 510, the toner T supplied to the developing roller 510 reaches a contact position of the control blade 560. During the course of passing by the abutting position, the toner T is electrically charged, and subjected to layer thickness regulation. By further rotation of the developing roller 510, the toner T on the developing roller 510, which has undergone layer thickness regulation, arrives at the developing position opposing the photosensitive body 20. In the developing position, the toner T is used for developing the latent image formed on the photosensitive body 20 under the alternating electric field. By still further rotation of the developing roller 510, the toner T on the developing roller 510, which has passed by the developing position, passes by the sealing member 520, and is collected into the developing device without being scraped off by the sealing member 520. The toner T still remaining on the developing roller 510 can be scraped off by the toner supplying roller 550.

As described above, the developing device holder 49 comprises the rotary 50 and a driving motor 401 for rotating the rotary 50. The rotary 50 is rotated by the driving force of the driving motor 401, to thus reach a predetermined position. This predetermined position includes a home position, a developing position, and a replacement position.

Figure 9:
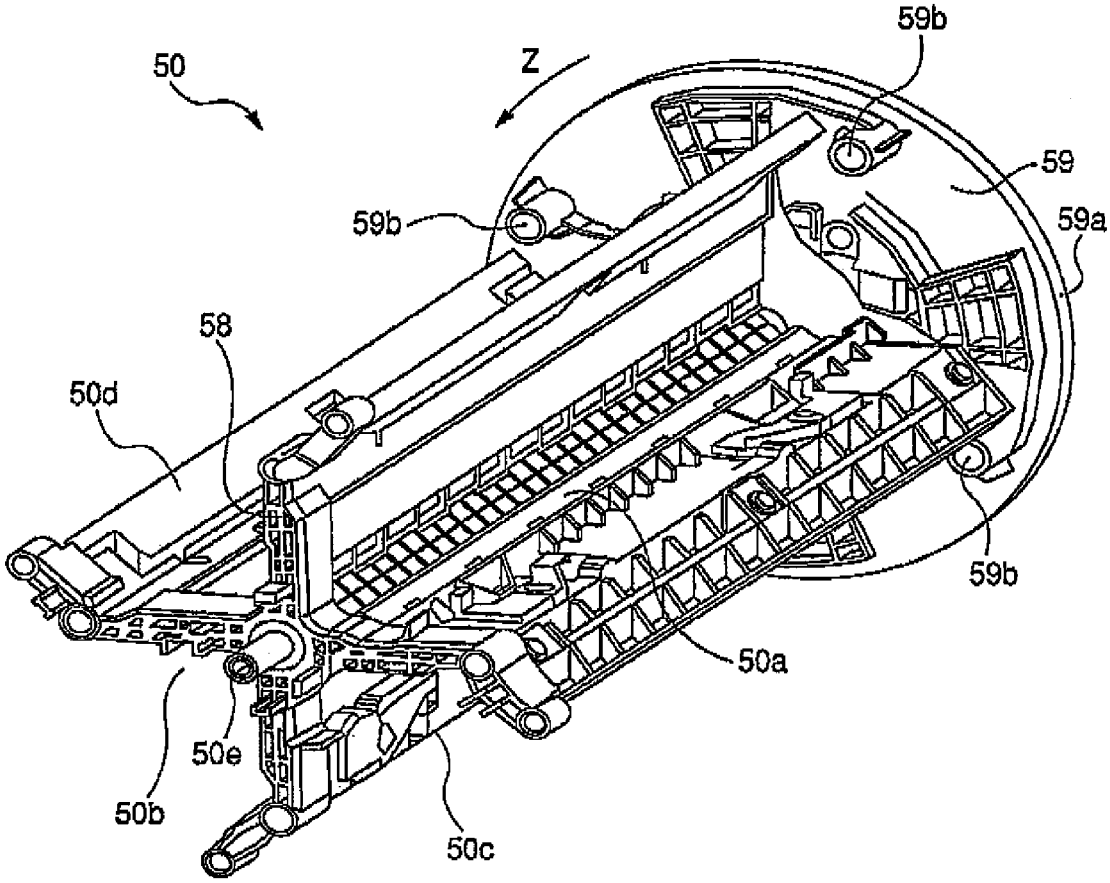
FIG. 9 is a perspective view of a rotary in the printer.

As shown in FIG. 9, the rotary 50 comprises a rotary shaft 50*e* located in the center of the rotary, a frame 58 for retaining the developing devices, and a circular plate 59 used for rotating the rotary 50.

The rotary shaft 50*e* extends horizontally between two frame side plates (not shown) forming an enclosure of the printer 10, and is supported at both ends thereof. The supporting frame 58 is mounted to the rotary shaft 50*e*. The four loading sections 50*a*, 50*b*, 50*c*, and 50*d*, which removably retain the above-described developing devices 51, 52, 53, and 54 around the rotary shaft 50*e*, are provided on the supporting frame 58 while being spaced apart from each other through 90 degrees in the circumferential direction.

The circular plate 59 is fastened to one axial end of the rotary shaft 50*e*. Teeth 59*a* are formed in an outer peripheral surface of the circular plate 59. The teeth 59*a* mesh with a gear 402 (which will be described later), and can rotate in the counterclockwise direction (a direction of Z) in FIG. 6. Accordingly, the circular plate 59 has the function of a gear which rotates the rotary 50. The circular plate 59 also has the positioning recess sections 59*b* into which the positioning pins 588 (FIG. 4) of the respective developing devices fit.

Figure 6:
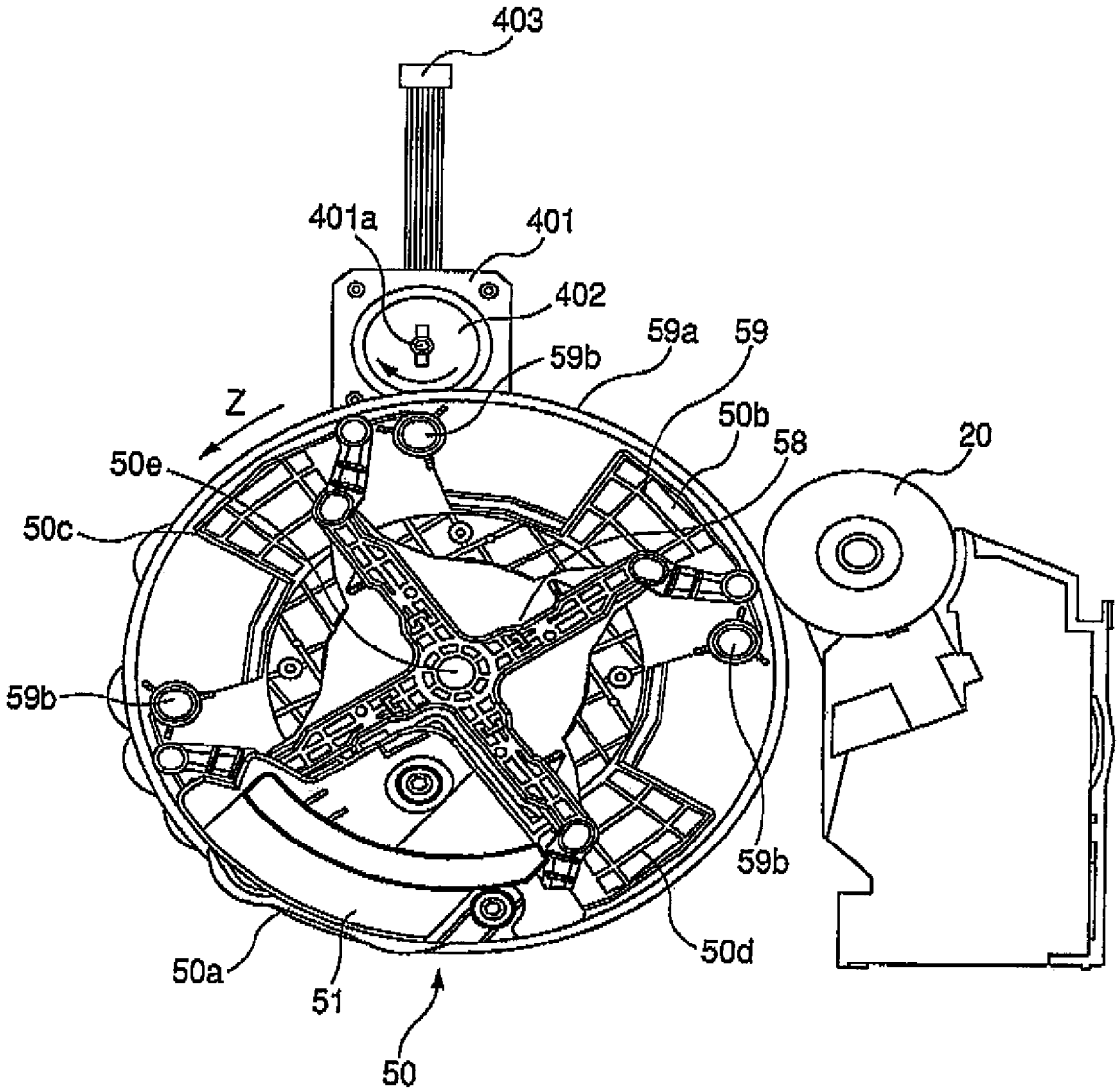
FIG. 6 is a schematic view showing a state that the black developing device is placed in a home position.

The driving motor 401 is a stepping motor. As shown in FIG. 6, the driving motor 401 has a motor shaft 401*a* provided with a gear 402. The gear 402 meshes with the teeth 59*a* of the circular plate 59 to thus transmit power to the circular plate 59. This gear 402 rotates in the clockwise direction shown in FIG. 6. The driving motor 401 is further provided with a connector 403 connected to the printer main body 10*a*, and power is supplied from the printer main body 10*a* to the driving motor 401 by way of the connector 403.

However, in terms of characteristics, the driving motor 401 has three types of torque (rotation torque, holding torque and detent torque) in accordance with operating conditions.

The rotation torque is one that develops when the motor shaft 401*a* of the driving motor 401, which is supplied with power by way of the connector 403, rotates. The holding torque is one that develops when the motor shaft 401*a* of the driving motor 401 that is supplied with power is controlled so as not to rotate. The detent torque is one that develops when no power is supplied to the driving motor 401.

The predetermined positions of the rotary 50; that is, the home position, the developing position, and the replacement position, will now be described.

The home position will first be described by reference to FIG. 6. The rotary 50 is situated at the home position when the printer 10 awaits execution of image forming operation. Even when no power is supplied to the printer 10, the rotary 50 is situated at the home position.

FIG. 6 shows the home position of the rotary 50 achieved when execution of image forming operation is awaited with the developing device (the black developing device 51) being loaded to one loading section; namely, the loading section 50*a*, among the plurality of loading sections 50*a*, 50*b*, 50*c*, and 50*d* (i.e., the printer 10 is used as a monochrome printer). The home position is a position where the loading section 50*a* is situated in the lowermost position among the plurality of loading sections 50*a*, 50*b*, 50*c*, and 50*d* with reference to the vertical direction.

The home position detector 31 for detecting the home position is provided at one axial end of the rotary shaft 50*e* of the rotary 50. The home position detector 31 comprises a disk, that is fastened to one end of the rotary shaft 50*e* and is to be used for generating a signal and a home position sensor consisting of a photo-interrupter having a light-emitting section and a light-receiving section, or the like.

A brim portion of the disk is arranged to reach a position between the light-emitting section and the light-receiving section of the home position sensor. When slit sections formed in the disk have moved to the detecting position of the home position sensor, a signal output from the home position sensor changes from "L" to "H." The home position of the rotary 50 is detected on the basis of the change in the signal level and the number of pulses of the pulse motor. The respective developing devices can be placed in the developing position, or the like, by taking the home position as a reference.

When the rotary 50 is situated in the home position in the printer 10, the driving motor 401 is not supplied with power. In such a situation, detent torque develops in the driving motor 401. Since the gear 402 of the driving motor 401 meshes with the teeth 59*a* provided on the rotary 50, the detent torque is exerted on the rotary 50. The printer 10 is configured such that the driving motor 401 retains the rotary 50 in the home position by the detent torque.

The developing position will now be described by reference to FIG. 7. The developing position is one used for placing the developing device loaded to the loading section in the position opposing the photosensitive body 20. The developing position of the rotary 50 is allocated to each of the developing devices loaded to the four loading sections 50*a*, 50*b*, 50*c*, and 50*d*. Namely, the developing positions are a black developing position of the rotary 50 acquired when the black developing device 51 loaded to the loading section 50*a* is placed in the developing position; a magenta developing position acquired when the magenta developing device 52 loaded to the loading section 50*b* is placed in the developing position; a cyan developing position when the cyan developing device 53 loaded to the loading section 50*c* is placed in the developing position; and a yellow developing position acquired when the yellow developing device 54 loaded to the loading section 50*d* is placed in the developing position.

Figure 7:
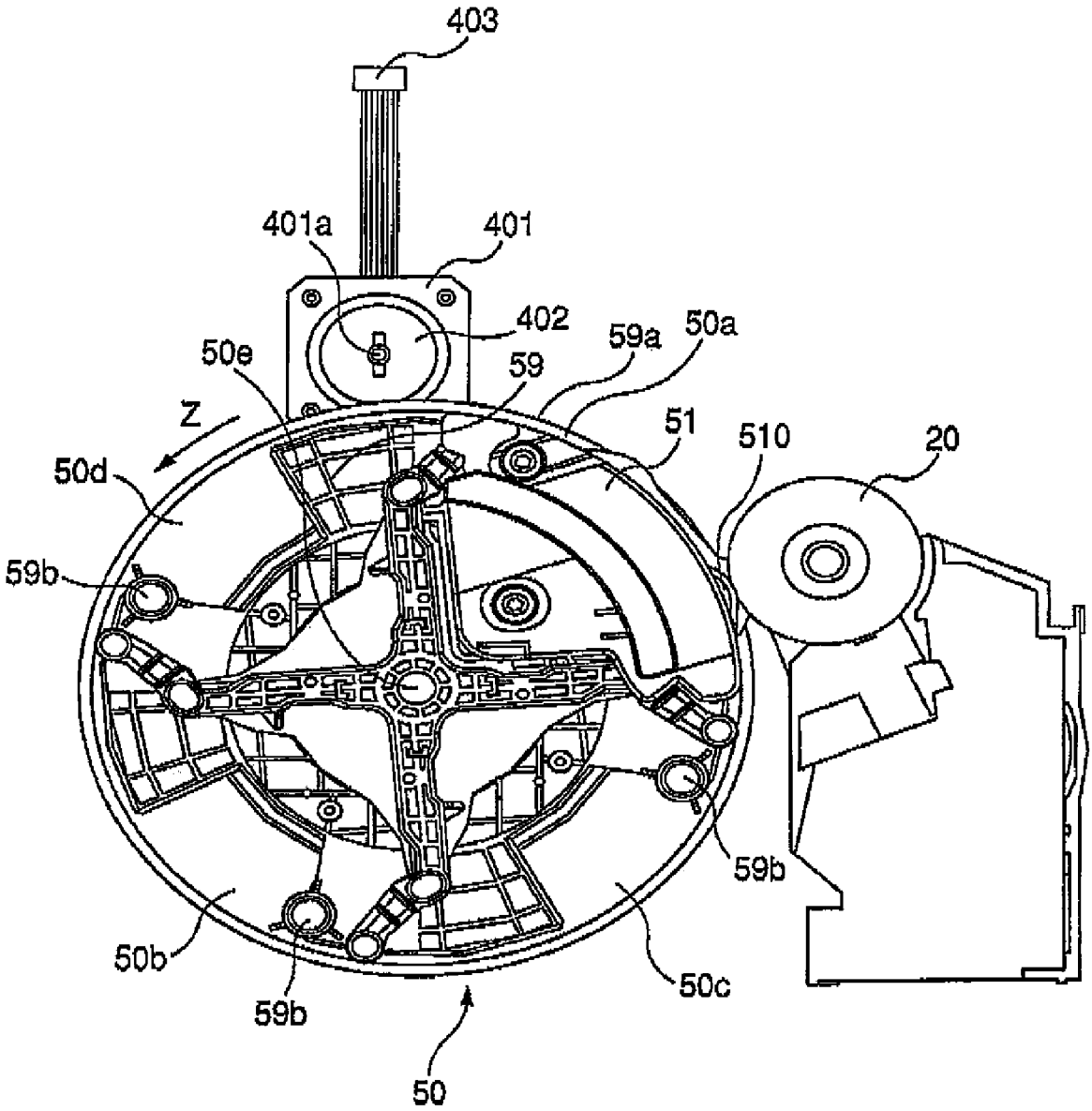
FIG. 7 is a schematic view showing a state that the black developing device is placed in a developing position.

FIG. 7 shows the black developing position of the rotary 50 achieved when the black developing device 51 is situated at the developing position opposing the photosensitive body 20. When the black developing device 51 has reached the developing position, the developing roller 510 loaded to the black developing device 51 opposes the photosensitive body 20. As a result, the latent image carried by the photosensitive body 20 can be developed with the black toner T carried by the developing roller 510.

When the rotary 50 is situated in the black developing position in the printer 10, the motor shaft 401*a* of the driving motor 401 supplied with power by way of the connector 403 is controlled so as not to rotate. Therefore, in such a case, holding torque develops in the driving motor 401.

The replacement position will now be described by reference to FIG. 8. The replacement position is a position for placing the loading section, to or from which the developing device is loaded or removed, in a position corresponding to a replacement opening 10*e*. The replacement position of the rotary 50 is allocated to each of the four loading sections 50*a*, 50*b*, 50*c*, and 50*d*. Namely, the replacement positions include a black replacement position of the rotary 50 achieved when the loading section 50*a*, to or from which the black developing device 51 is loaded or removed, is placed in the position opposing the replacement opening 10*e*; a magenta replacement position of the rotary 50 achieved when the loading section 50*b*, to or from which the magenta developing device 52 is loaded or removed, is placed in the position opposing the replacement opening 10*e*; a cyan replacement position of the rotary 50 achieved when the loading section 50*c*, to or from which the cyan developing device 53 is loaded or removed, is placed in the position opposing the replacement opening 10*e*; and a yellow replacement position of the rotary 50 achieved when the loading section 50*d*, to or from which the yellow developing device 54 is loaded or removed, is placed in the position opposing the replacement opening 10*e*.

Figure 8:
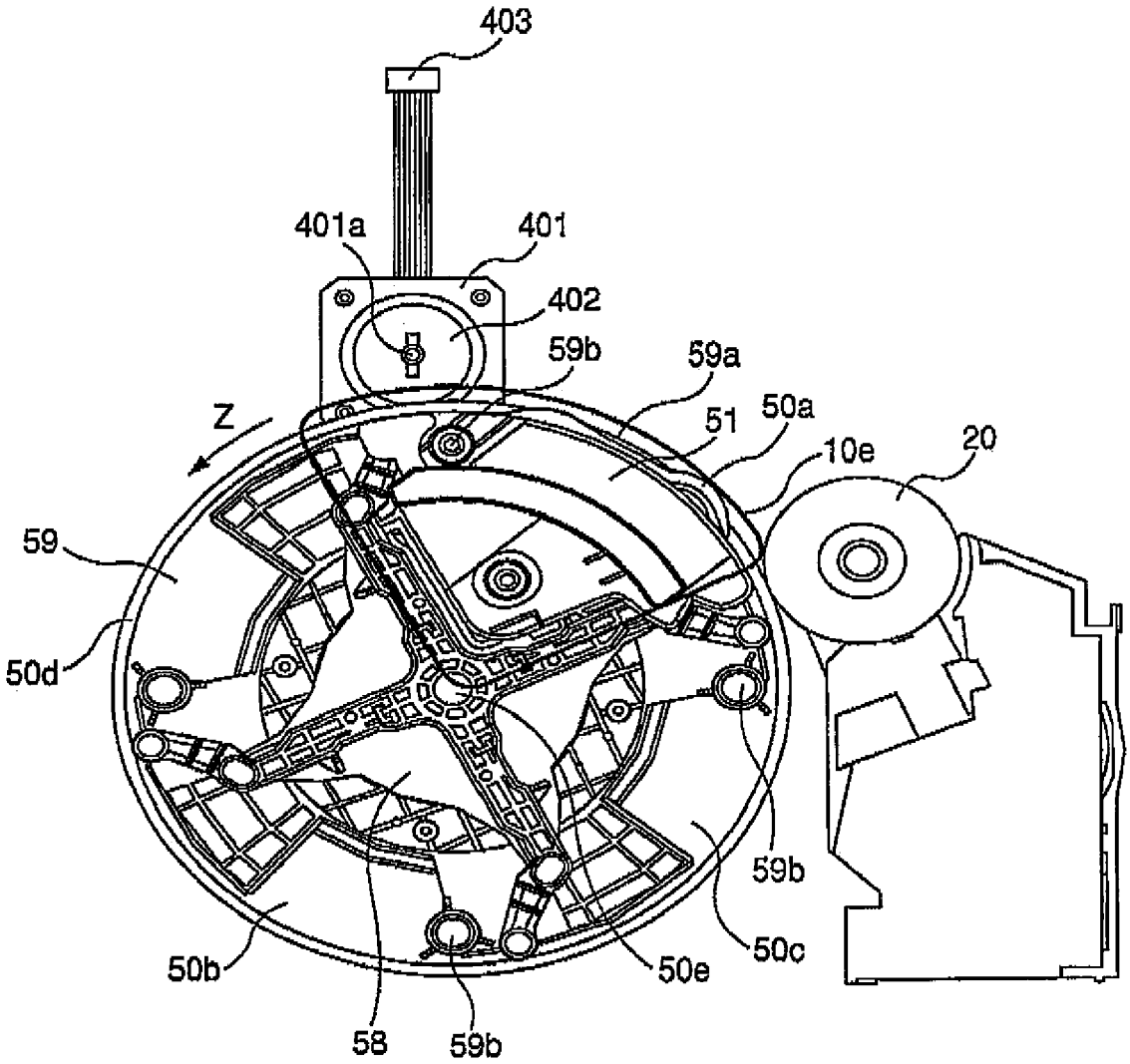
FIG. 8 is a schematic view showing a state that the black developing device is placed in a replacement position.

FIG. 8 shows the black replacement position achieved when the loading section 50*a* is situated in the position opposing the replacement opening 10*e*. When the rotary 50 is situated in the black replacement position; namely, when the loading section 50*a* is situated in the position opposing the replacement opening 10*e*, the black developing device 51 is removably loaded to the loading section 50*a* by way of the replacement opening 10*e*. The black replacement position is a position where the loading section 50*a* among the plurality of loading sections 50*a*, 50*b*, 50*c*, and 50*d* is situated in the highest position with reference to the vertical direction.

In the printer 10, when the rotary 50 is situated in the black replacement position, no power is supplied to the driving motor 401. Therefore, in such a case, detent torque is exerted in the driving motor 401. The printer 10 is configured such that the driving motor 401 retains the rotary 50 in the black replacement position by the detent torque.

The printer 10 of the present embodiment does not have any locking member which locks the rotary 50 by contacting the same when the rotary 50 is situated in the home position or the black replacement position. Namely, when the rotary 50 is situated in the home position or the black replacement position, the rotary 50 is retained in the home position or the black replacement position by only the detent torque of the driving motor 401.

An example operation of the printer 10 will now be described. A monochrome image forming operation, by which the printer 10 forms a monochrome image when being used as a monochrome printer, will be described hereinbelow. Moreover, there will be provided a description about replacement operation by which the black developing device 51 is loaded to or removed from the loading section 50*a*.

When the operator activates the printer 10, power is supplied to the printer 10, and the printer 10 awaits execution of image forming operation. At that time, the rotary 50 is situated in the home position shown in FIG. 6. In a state where the printer 10 awaits execution of image forming operation, no power is supplied to the driving motor 401. Accordingly, detent toque develops in the driving motor 401. The rotary 50 that awaits execution of image forming operation is retained in the home position by the detent torque.

When an image signal and a control signal, both of which have been output from an unillustrated computer, are input to the main controller 101 of the printer 10 by way of the interface 112, the photosensitive body 20, the rotary 50, and the intermediate transferring unit 70 rotate under control of the unit controller 102 on the basis of the command from the main controller 101.

The photosensitive body 20 is sequentially charged, while being rotated, by the charging unit 30 in the charging position. A charged area of the photosensitive body 20 reaches the exposure position in association with rotation of the photosensitive body 20, and a latent image corresponding to image data is formed in that area by the exposing unit 40.

The rotary 50 situated in the home position shown in FIG. 6 is rotated by the driving force of the driving motor 401 that is supplied with power from the printer main body by way of the connector 403, and reaches the black developing position shown in FIG. 7. In that case, the black developing device 51 loaded to the loading section 50*a* is situated in the position opposing the photosensitive body 20. After the rotary 50 has stopped its rotation to the black developing position, the developing roller 510 of the black developing device 51 rotates. When the rotary 50 has reached the black developing position, the motor shaft 401*a* of the driving motor 401 supplied with power is controlled so as not to rotate. Therefore, holding torque is exerted in the driving motor 401. The rotary 50 is retained in the black developing position by the holding torque.

The latent image formed on the photosensitive body 20 reaches a developable position in association with rotation of the photosensitive body 20, and is developed by the developing roller 510 of the black developing device 51. Thereby, a toner image is formed on the photosensitive body 20.

In association with rotation of the photosensitive body 20, the toner image formed on the photosensitive body 20 reaches a primary transfer position, and is transferred onto the intermediate transferring unit 70 by the primary transferring unit 60. In this case, a primary transfer voltage, whose polarity is opposite that of the electrical charges on the toner, is applied to the primary transferring unit 60. During this time, the secondary transferring unit 80 is spaced apart from the intermediate transferring member 70.

The toner image formed on the intermediate transferring unit 70 reaches a secondary transfer position in association with rotation of the intermediate transferring unit 70, and is transferred onto a medium by the secondary transferring unit 80. The medium is transported to the secondary transferring unit 80 from the sheet feeding tray 92 by way of a sheet feeding roller 94 and registration rollers 96. When the transfer operation is performed, the secondary transferring unit 80 is pressed against the intermediate transferring unit 70, and a secondary transfer voltage is applied to the secondary transferring unit 80.

The toner image having been transferred onto the medium is heated and pressed by the fusing unit 90 to thus be fused onto the medium.

Meanwhile, after the photosensitive body 20 has passed by the primary transfer position, the toner T sticking to the surface of the photosensitive body 20 is scraped off by the cleaning blade 76 supported on the cleaning unit 75, whereby turning the photosensitive body 20 into a standby state for the formation of next latent image. The thus-scraped toner is recovered in a residual-toner recovering section provided in the cleaning unit 75.

After the toner image has been formed on the photosensitive body 20, the rotary 50 situated in the black developing position shown in FIG. 7 rotates to reach the home position shown in FIG. 6. The printer 10 awaits execution of image forming operation. In that case, detent toque is exerted in the driving motor 401. The rotary 50 is retained in the home position by this detent torque.

Next, when the operator deactivates the printer 10, power supply to the printer 10 is stopped. Even when no power is supplied to the printer 10, the rotary 50 is maintained at the home position shown in FIG. 6. The rotary 50 is retained in the home position by detent torque.

Removal/loading operation of the black developing device 51 will now be described. In the printer 10, the black developing device 51 is loaded to the loading section 50*a*, and the rotary 50 is situated in the home position shown in FIG. 6.

First, the rotary 50 situated in the home position is rotated by the driving force of the driving motor 401, to thus reach the black replacement position shown in FIG. 8. When the rotary 50 remains positioned in the black replacement position, no power is supplied to the driving motor 401. Hence, detent torque is exerted in the driving motor 401. When being positioned in the black replacement position, the rotary 50 is retained at the black replacement position by detent torque of the driving motor 401.

Next, the operator removes the black developing device 51 loaded to the loading section 50*a*, by way of the replacement opening 10*e*. A new black developing device 51 is loaded to the loading section 50*a* by the operator by way of the replacement opening 10*e*. After the new developing device 51 has been loaded to the loading section 50*a*, the rotary 50 situated in the black replacement position is rotated by the driving force of the driving motor 401, to thus reach the home position shown in FIG. 6. The printer 10 awaits execution of image forming operation.

As shown in FIG. 6, in a case where the rotary 50 is situated in the home position, since the one loading section 50*a* equipped with the black developing device 51 is located at the lowest position among the plurality of loading sections 50*a*, 50*b*, 50*c*, and 50*d* with reference to the vertical direction, the rotary 50 becomes stable. Moreover, since the driving motor 401 retains the rotary 50 at the home position with detent torque when the rotary 50 is situated at the home position, the detent torque serves as retention force for retaining the rotary 50. When the above two matters are combined together, the rotary 50 situated at the home position is retained more stably. Consequently, according to the present embodiment, the printer 10 capable of preventing displacement of the rotary 50 situated at the home position can be realized.

As shown in FIG. 8, when the black developing device 51 is removed from or loaded to the loading section 50*a*, the rotary 50 is located in the black replacement position where the loading section 50*a* is located at the highest position among the plurality of loading sections 50*a*, 50*b*, 50*c*, and 50*d* with reference to the vertical direction.

Figure 10:
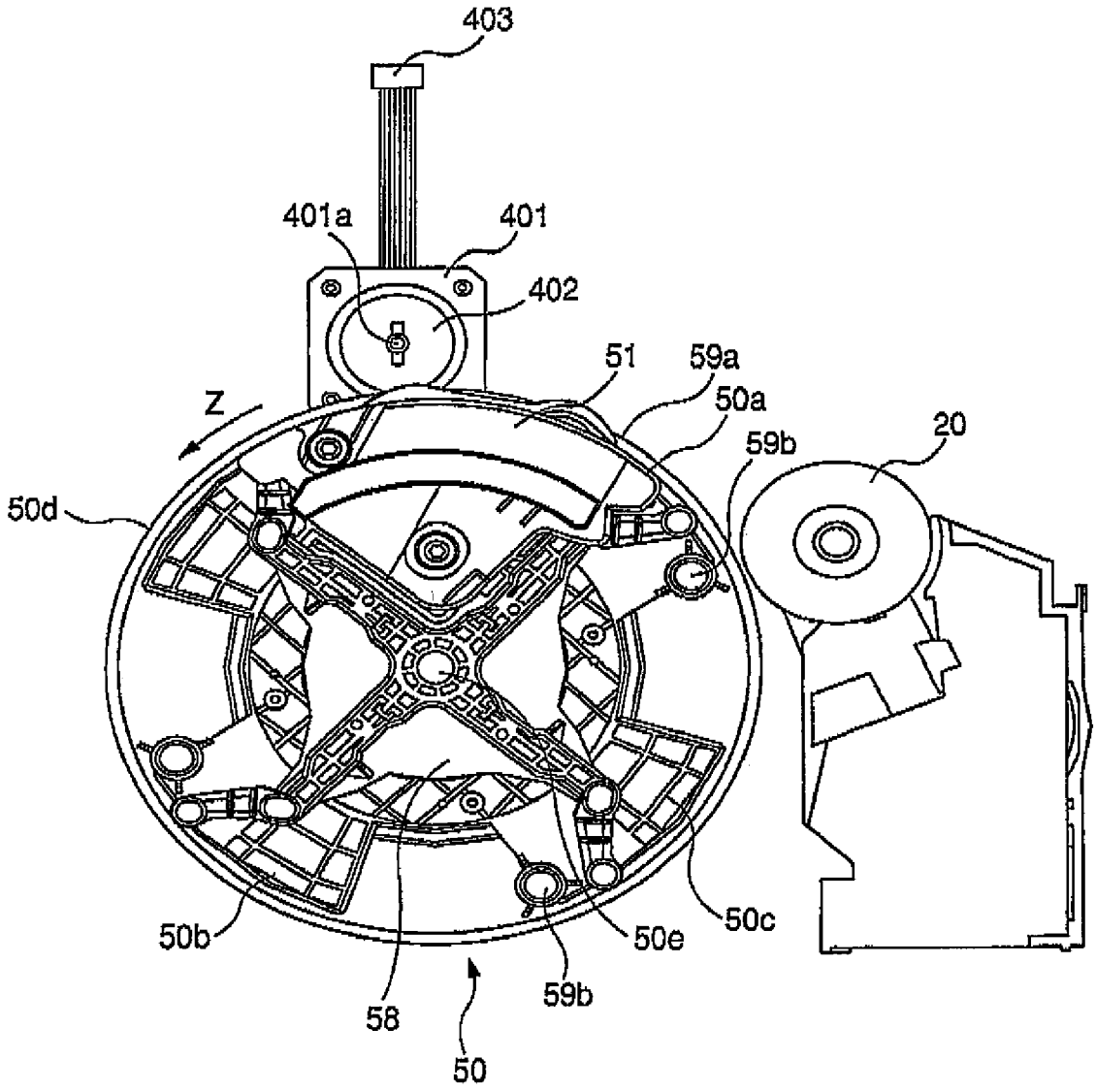
FIG. 10 is a schematic view showing a state that the black developing device is placed in the home position, according to another example.

However, as shown in FIG. 10, the home position may be a position where the one loading section 50*a* is located at the highest position among the plurality of loading sections 50*a*, 50*b*, 50*c*, and 50*d* with reference to the vertical direction. Even in such a case, the rotary 50 is retained stably, and hence it is possible to prevent displacement of the rotary 50 situated in the home position.

Figure 11:
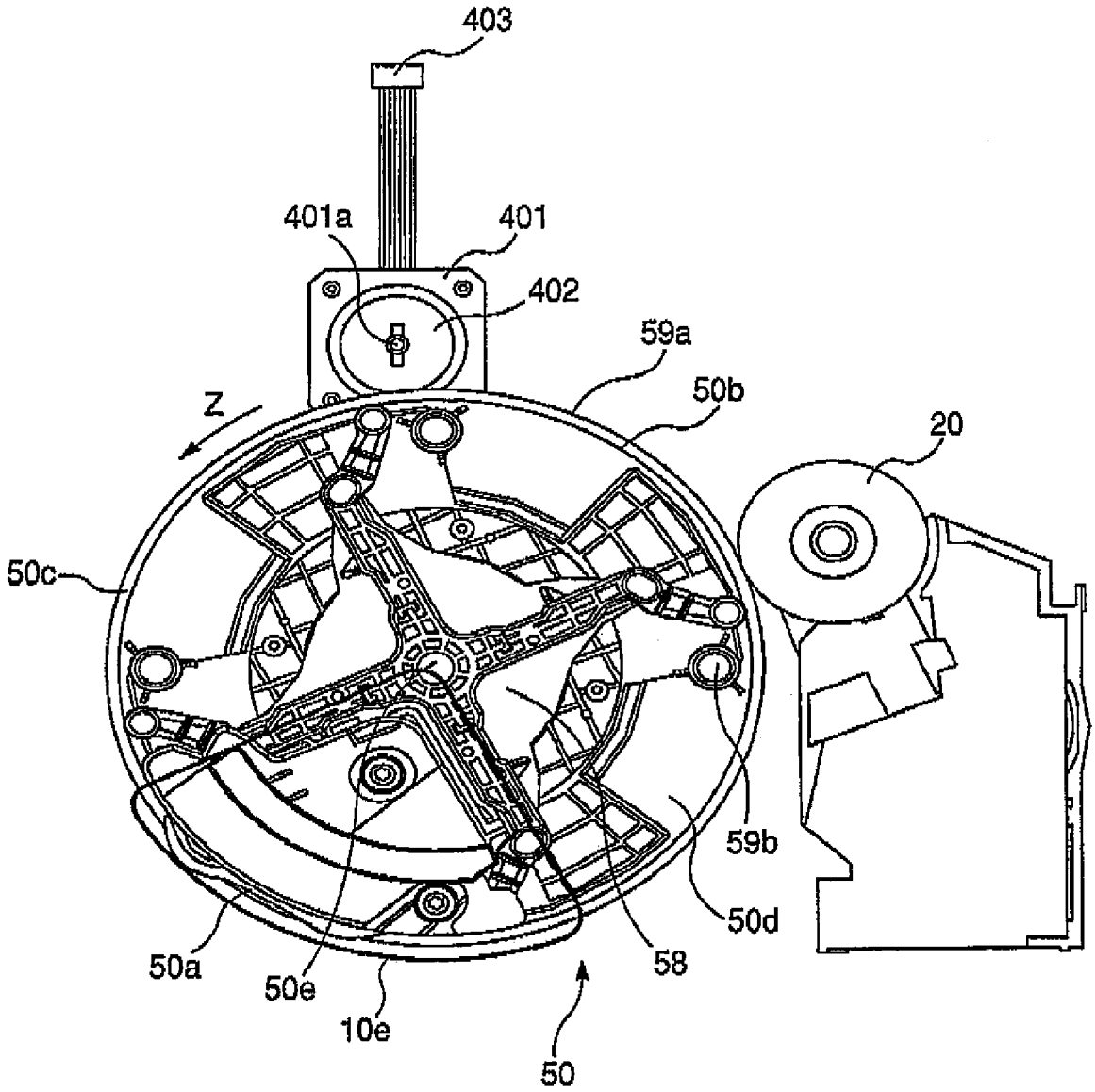
FIG. 11 is a schematic view showing a state that the black developing device is placed in the replacement position, according to another example.

In addition, as shown in FIG. 11, the black replacement position may be a position where the loading section 50*a* is located at the lowest position among the plurality of loading sections 50*a*, 50*b*, 50*c*, and 50*d* with reference to the vertical direction.

The image forming apparatus, and the like, according to the present invention has hitherto been described by reference to the embodiment. However, the above-described embodiment of the invention aims at facilitating understanding of the invention, and should not be construed as limiting the range of the invention. As a matter of course, the invention can be changed and modified without departing from the scope of the invention, and equivalents thereof are included in the invention.

The above embodiment has been described while an intermediate transferring type full-color laser beam printer is taken as an image forming apparatus. However, the present invention can also be applied to a variety of types of image forming apparatus, such as a full-color laser beam printer of a type other than the intermediate transfer type, a monochrome laser beam printer, a copying machine, or a facsimile.

In the above embodiment, the photosensitive body serving as an image carrier has been described as having a configuration of a photosensitive layer being provided on an outer circumferential surface of the cylindrical conductive substrate. However, the photosensitive body may be a so-called photosensitive belt having a configuration of a photosensitive layer being provided on the surface of a belt-shaped conductive substrate.

In the above embodiment, the driving motor 401 is a stepping motor. However, the driving motor 401 may be a DC motor.

In the above embodiment, the rotary 50 is situated at the home position when no power is supplied to the printer 10. However, the rotary 50 may be situated at the home position when execution of image forming operation is awaited. When no power is supplied to the printer 10, the rotary 50 may be situated at a position differing from the home position.

Next, an image forming system incorporating the above image forming apparatus will be described.

Figure 12:
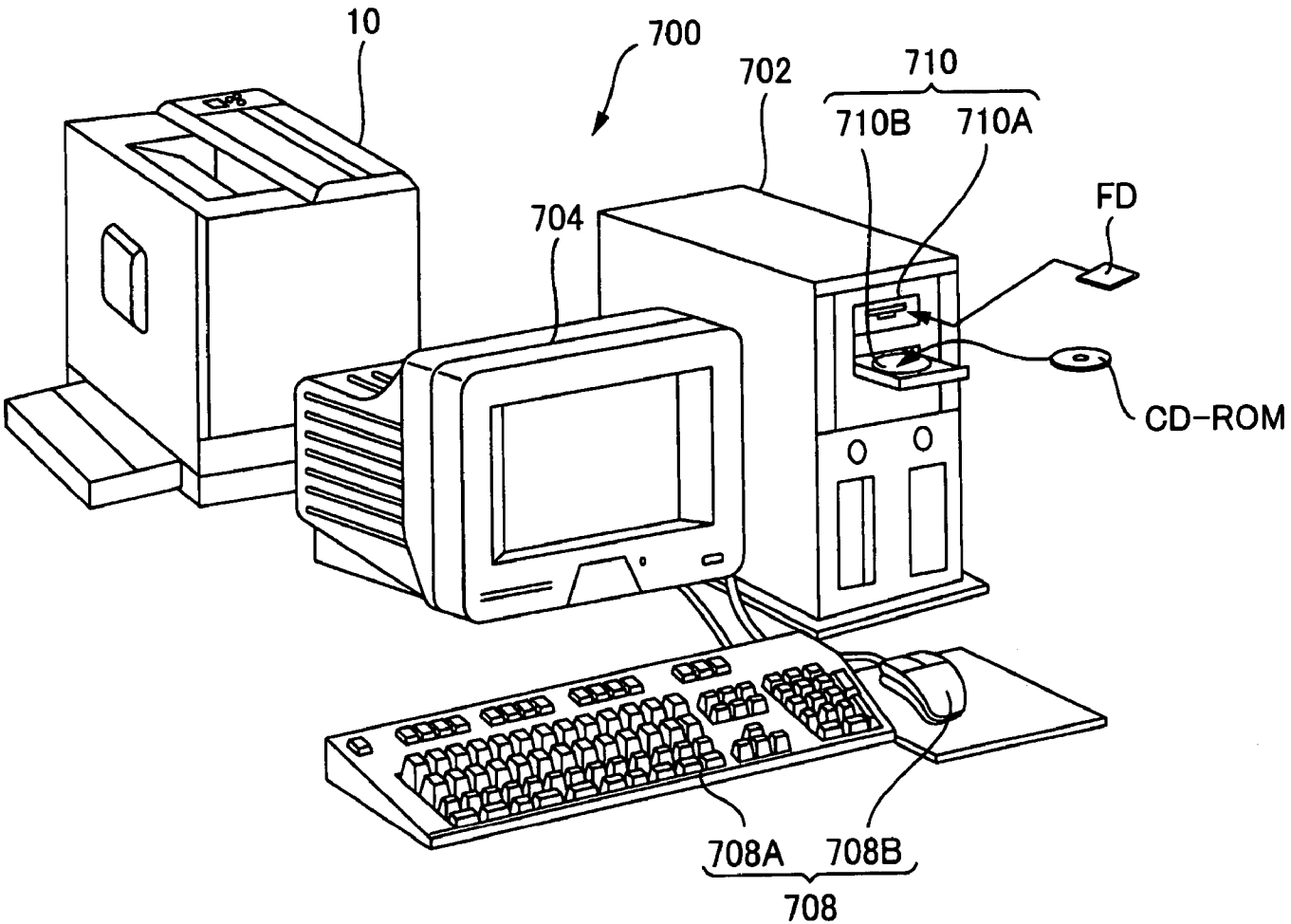
FIG. 12 is a perspective view of an image forming system incorporating the printer.

As shown in FIG. 12, an image forming system 700 comprises a computer 702, a display device 704, the printer 10, input devices 708, and reading devices 710.

The computer 702 of the present embodiment is enclosed in a mini-tower-type enclosure; however, the configuration is not limited to this type. A CRT (cathode ray tube), a plasma display, a liquid crystal display device, or the like, is generally employed for the display device 704; however, the display device is not limited to them. A keyboard 708A and a mouse 708B are employed in the embodiment as the input devices 708; however, the input devices are not limited to them. A flexible disk drive device 710A and a CD-ROM drive device 710B are employed in the embodiment as the reading devices 710; however, the reading devices are not limited to them. For instance, another device, such as an MO (magneto optical) disk drive, or a DVD (digital versatile disk), or the like may also be employed.

Figure 13:
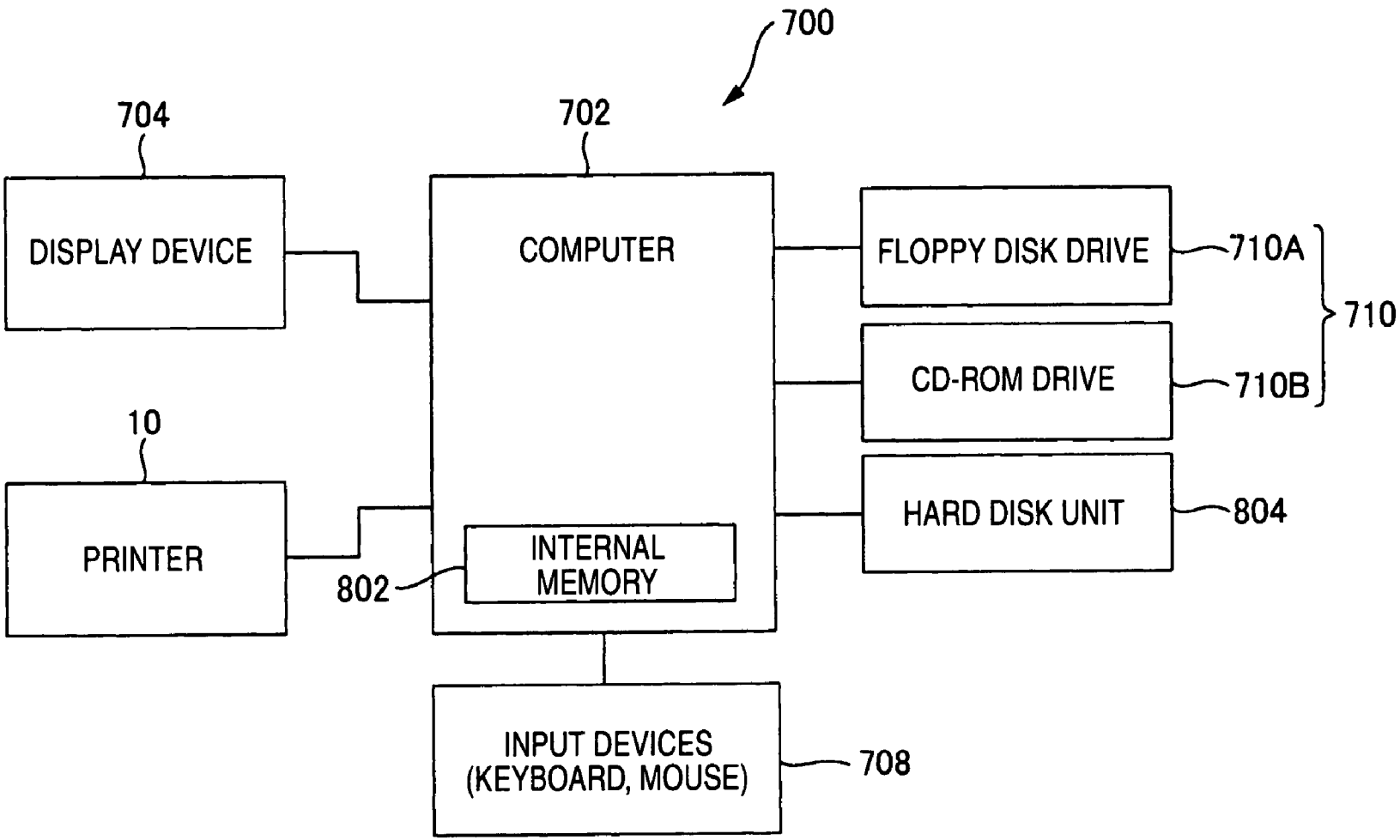
FIG. 13 is a block diagram of the image forming system.

As shown in FIG. 13, an internal memory 802 such as a RAM and an external memory such as a hard disk drive unit 804 are further provided in the enclosure where the computer 702 is enclosed.

The above description has described the example where the printer 10 is connected to the computer 702, the display device 704, the input devices 708, and the reading devices 710, thereby forming the image forming system. However, the present invention is not limited to this example. For instance, the image forming system may be formed from the computer 702 and the printer 10, or the image forming system may not include any of the display device 704, the input devices 708, and the reading devices 710.

Alternatively, e.g., the printer 10 may include portions of functions or mechanisms of the computer 702, the display device 704, the input devices 708, and the reading devices 710. As an example configuration, the printer 10 may include an image forming section for effecting image processing, a display section for performing a variety of display operations, a recording medium loading section for removably loading a recording medium where image data having been captured by a digital camera, or the like, are recorded, and the like.

The image forming system realized as described above becomes superior to the related-art system in terms of overall execution.

What is claimed is:

1. An image forming apparatus, comprising:

an image carrier, adapted such that an electrostatic latent image is formed thereon;

a rotary member, having a plurality of loading sections each of which is adapted to accommodate a developing device which is operable to develop the electrostatic latent image; and a motor, operable to rotate the rotary member so that each of the loading sections is sequentially opposed to the image carrier, and operable to exert a detent torque when no power is supplied thereto; wherein:

a home position is defined, in a case where only one of the loading sections accommodates the developing device, such that the one of the loading sections is placed in a position lower than any other loading sections;

the motor rotates the rotary member to the home position at least when the development of the electrostatic latent image is not performed; and the rotary member is retained in the home position with the detent torque exerted by the motor.

2. The image forming apparatus as set forth in claim 1, wherein:

the motor is a stepping motor.

3. The image forming apparatus as set forth in claim 1, wherein:

the rotary member is retained in the home position without any locking member.

4. The image forming apparatus as set forth in claim 1, wherein:

the motor rotates the rotary member to the home position when the image forming apparatus is deactivated.

5. The image forming apparatus as set forth in claim 1, wherein:

the motor rotates the rotary member to a replacement position in which the one of the loading sections equipped with the developing device is placed in a position higher than any other loading sections, when replacement of the developing device is performed; and the rotary member is retained in the replacement position with the detent torque exerted by the motor.

6. An image forming system, comprising:

the image forming apparatus as set forth in claim 1; and a computer, communicatively connected to the image forming apparatus and operable to cause the image forming apparatus to execute an image forming operation.

7. An image forming apparatus, comprising:

an image carrier, adapted such that an electrostatic latent image is formed thereon;

a rotary member, having a plurality of loading sections each of which is adapted to accommodate a developing device which is operable to develop the electrostatic latent image; and a motor, operable to rotate the rotary member so that each of the loading sections is sequentially opposed to the image carrier, and operable to exert a detent torque when no power is supplied thereto; wherein:

a home position is defined, in a case where only one of the loading sections accommodates the developing device, such that the one of the loading sections is placed in a position higher than any other loading sections;

the motor rotates the rotary member to the home position at least when the development of the electrostatic latent image is not performed; and the rotary member is retained in the home position with the detent torque exerted by the motor.

8. The image forming apparatus as set forth in claim 7, wherein:

the motor is a stepping motor.

9. The image forming apparatus as set forth in claim 7, wherein:

the rotary member is retained in the home position without any locking member.

10. The image forming apparatus as set forth in claim 7, wherein:

the motor rotates the rotary member to the home position when the image forming apparatus is deactivated.

11. The image forming apparatus as set forth in claim 7, wherein:

the motor rotates the rotary member to a replacement position in which the one of the loading sections equipped with the developing device is placed in a position lower than any other loading sections, when replacement of the developing device is performed; and the rotary member is retained in the replacement position with the detent torque exerted by the motor.

12. An image forming system, comprising:

the image forming apparatus as set forth in claim 7; and a computer, communicatively connected to the image forming apparatus and operable to cause the image forming apparatus to execute an image forming operation.

* * * * *